United States Patent [19]

Cummings et al.

[11] Patent Number: 4,683,678

[45] Date of Patent: Aug. 4, 1987

[54] ADJUSTABLE RAILWAY BOXCAR DOOR

[75] Inventors: Ralph E. Cummings, Omaha, Nebr.; Denis R. Brzezinski, Richton Park, Ill.

[73] Assignee: Railcar Specialties, Inc., Alsip, Ill.

[21] Appl. No.: 853,191

[22] Filed: Apr. 17, 1986

[51] Int. Cl.[4] ..... E05D 15/06

[52] U.S. Cl. ..... 49/426; 49/472

[58] Field of Search ..... 49/426, 427, 372, 472

[56] References Cited

U.S. PATENT DOCUMENTS

| | | | |
|---|---|---|---|
| 1,922,042 | 8/1933 | Henricks | 49/426 |
| 1,925,655 | 9/1933 | Ditchfield | 49/426 |
| 3,494,076 | 2/1970 | Todd | 49/372 X |
| 4,319,431 | 3/1982 | Siers | 49/426 |
| 4,447,986 | 5/1984 | Wilkins et al. | 49/426 |

*Primary Examiner*—Kenneth Downey

*Attorney, Agent, or Firm*—Leo J. Aubel; Ralph R. Rath

[57] ABSTRACT

An adjustable railway car door kit having a bottom section and a top section which have front and rear channel-shaped post means that receive a reinforcement alignment channel therein so that the top section can be permanently welded to the bottom section through the post means and the extension, as well as the overlapping portion of the sheets that extend between the post means. A width adjustment is also provided through a integral flange on the rear post means and a generally J-shaped rear edge extension, which can be welded in adjusted positions to the flange.

9 Claims, 12 Drawing Figures

FIG. 9
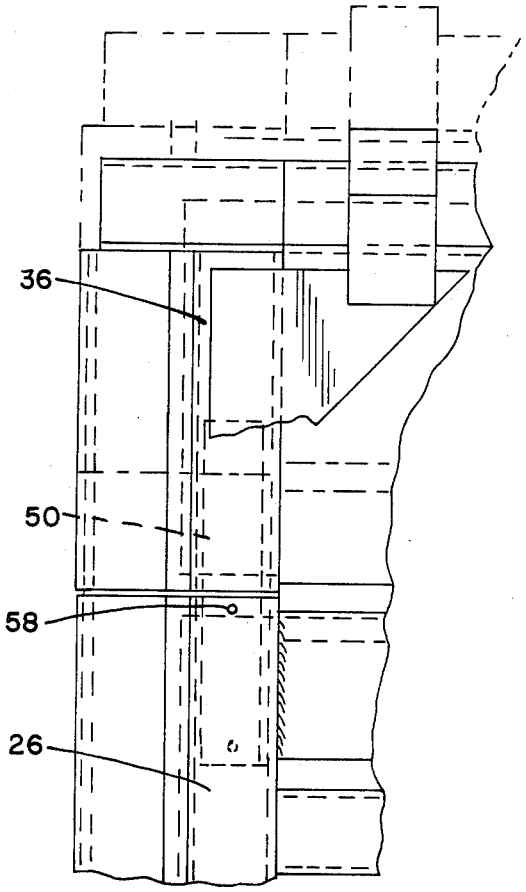
FIG. 10
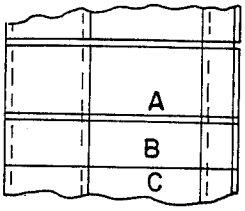
FIG. 11
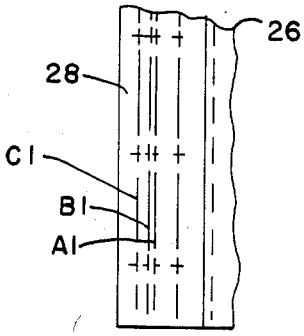
| CAR CLASS | DOOR WIDTH | WIDTH ADJ. | DOOR HEIGHT | HEIGHT ADJ. | BOTTOM EDGE |
|---|---|---|---|---|---|
| 1 | 8' 4 3/8" | NONE | 11' 0 3/4" | C | Fig.6 |
| 2 | 8' 4 3/8" | NONE | 11' 4 15/16" | NONE | Fig.6 |
| 3 | 8' 5 1/8" | A1 | 11' 2 5/16" | B | Fig.6 |
| 4 | 8' 5 5/8" | C1 | 11' 0 3/4" | C | Fig.7 |
| 5 | 8' 5 1/4" | B1 | 11' 2 1/2" | A | Fig.8 |
| | | | | | |
FIG. 12

ADJUSTABLE RAILWAY BOXCAR DOOR

TECHNICAL FIELD

The present invention relates generally to railroad boxcars and, more particularly, to an adjustable door that can be used with railway boxcars that have varying sizes of door openings.

BACKGROUND PRIOR ART

Railroad boxcars generally have an opening on one or both sides which are covered by a single door or an auxiliary door and a main door that can be opened for loading and unloading and are closed in a locked and sealed condition during transportation. In the past decades, a number of different manufacturers have been involved in the manufacture of railroad cars and, thus, a variety of different classes of railroad boxcars are being utilized by various transportation companies.

While certain standards are set as requirements for the various classes of railroad cars, there appears to be no fixed standard for the exact size of the opening that is created in the boxcar. Thus, while the openings of different car manufacturers are fairly close, there are some variations of the size of the opening for each of the variety of sizes and types of railroad cars. Manufacturers of such railroad cars appear to purposely design the dimension of the opening such that only a door manufactured by them will fit the size of the opening. It will be appreciated that the life span of the railroad car is considerably longer than the life span of the door, which is subject to considerable abuse during use. Thus, these doors must be replaced periodically and the manufacturer thereby has the opportunity for the sale of its custom-fitted doors.

While adjustable doors have been proposed for railroad cars, the types of adjustment that have been made heretofore have been not entirely satisfactory because the adjustment is made in close proximity to the upper edge of the door when a height adjustment is made and, thus, weakens the structural rigidity of the joints at a location which is most critical or is made at the lower edge where all of the support structure is located.

SUMMARY OF THE INVENTION

According to the present invention, a railway boxcar door kit has been developed which can be manufactured and shipped in a preassembled condition and which can be adjusted for width and height at the job site and can then be permanently welded for subsequent use. The door kit includes a lower and upper door section, each having hollow channels defining front and rear edges of the door, with the rear channels having rearwardly-directed integral flanges extending therefrom. The flanges have spaced scribe lines defining different width adjustments for the door, and a generally J-shaped rear edge extension is adapted to be aligned with any of the scribe lines to define different width adjustments for the door, with the extension being thereafter permanently welded to the flanges.

A pair of reinforcement alignment channels are received into the channels of the upper section and are permanently welded therein. These reinforcement channels also extend into the channels of the lower section which have scribe lines defining different height adjustments between the door sections. In assembly of the door sections at the factory, the reinforcement channels are tack-welded into the lower channels of the lower section for shipment and handling and also have a pair of reinforcement bolts extending therethrough which provide stability between the sections during lifting and handling prior to being permanently welded in an adjusted position.

In its specific embodiment, the door opening is closed by a main door and an auxiliary door with the width and height adjustments described above, while the main door has only a height adjustment.

BRIEF DESCRIPTION OF SEVERAL VIEWS OF DRAWINGS

FIG. 9 is an enlarged fragmentary plan view of the corner portion of the door;

FIG. 10 is an enlarged fragmentary plan view of the scribe lines used for height adjustment of the door sections;

FIG. 11 is a fragmentary enlarged plane view of the scribe lines used for width adjustments; and FIG. 12 is a chart showing the height and width adjustments that are made using the scribe lines shown in FIGS. 10 and 11.

DETAILED DESCRIPTION

Figure 1:
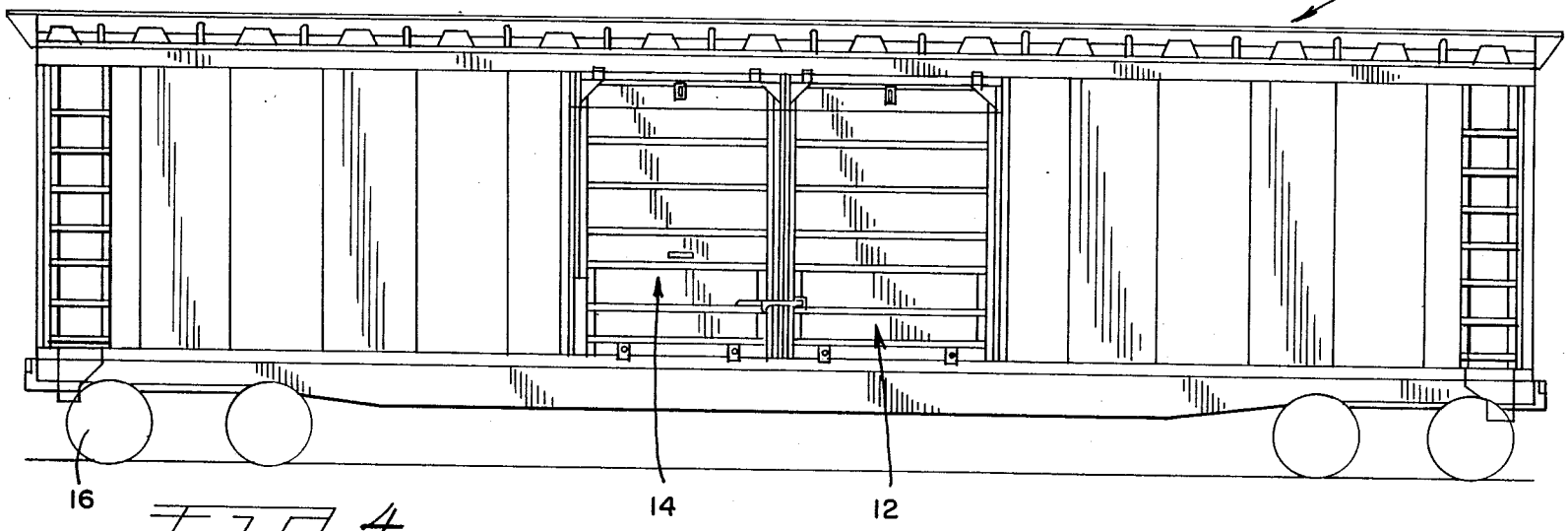
FIG. 1 is a side view of a railway boxcar having doors constructed in accordance with the present invention associated therewith.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

FIG. 1 of the drawings discloses a railway boxcar, generally designated by reference numeral 10, having an opening (not shown) which is closed by a main door 12 and an auxiliary door 14.

As indicated above, the opening that is enclosed by the main and auxiliary doors 12 and 14 is generally of the size of about 11 feet in height and about 17 feet in width and usually the two doors are made to compliment each other and be of generally equal size to enclose the opening therein. However, because of different classes of cars manufactured by different railcar manufacturers, the width and height dimensions of the opening vary to some degree so that the manufacturer of each particular car will automatically have a competitive advantage when it becomes necessary to replace the door. This is true since the dimensions of the opening vary to a small degree and therefore require doors of different sizes to accommodate the varying size of the opening. This in the past has created significant problems for manufacturers of replacement doors, since it requires a substantial inventory of different size doors to accommodate width and height to insure that the opening is completely closed and sealed.

In addition, the various manufacturers have different types of door tracks which are utilized for supporting the doors in a rolling fashion between the open and closed positions, as well as different types of top lateral edge sealing means for insuring that the opening is completely enclosed and sealed. Thus, the replacement door not only requires differences in height and width, but also requires different configurations for the bottom and top edges which would require the replacement door manufacturer to significantly increase the inventory to accommodate all of the variations.

While adjustable doors have been previously suggested, one of the problems that is inherent in the prior art type adjustments is the fact that the adjustments are made at the upper corners of the door and thereby decrease the structural rigidity of the finished unit after the final adjustments have been made. It will be appreciated that the corners or the joints adjacent the corners of the door of this type are most susceptible to the greatest stress for the door during use. Also, if the adjustment is made adjacent the lower edge of the door, the adjustment becomes even more difficult since most of the support structure, including the hardware for supporting the door on the rail and the latching mechanism closing the door, and the mechanism for interconnecting adjacent doors, is located adjacent the bottom of the door.

Figure 5:
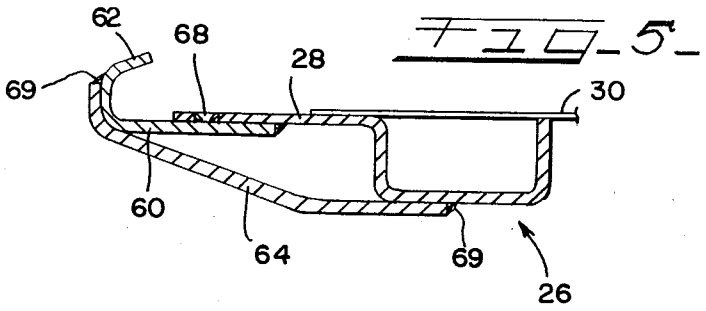
FIG. 5 is a cross-sectional view of the rear edge of the auxiliary door.

According to the present invention, a railway boxcar door kit includes doors 12 and 14 which are provided with a width and height adjustment for accommodating the varying size openings. For this purpose, auxiliary door 14 has a lower or bottom section 20 and a top or upper section 22 which defines a small extension of the lower section. The lower section has front and rear edge post means 24 and 26 which define the front and rear edges of the door. As shown in FIG. 5, the post means 24 and 26 are channel-shaped in cross-section and post means 26 has an integral rearwardly-directed flange 28. A sheet, preferably of metal, extends between the post means 24 and 26 and defines the major portion of the door. The sheet 30 may be reinforced by reinforcing channels 32, which extend horizontally and are vertically spaced from each other.

Likewise, the upper section or extension 22 has front and rear edge post means 34 and 36 which define extensions of the post means 24 and 26 and are identical in cross-section, with the upper section also having a sheet 38 extending between the front and rear post means 34 and 36 and the upper sheet 38 has an overlapping extension 39 with the upper edge of the lower sheet 30.

The lower section 14, which encompasses the major portion of the door 14, has all of the hardware associated therewith, such as the rollers or support means 40 that are located in pockets 41 and support the door on the rails, which will be described later. The lower bottom section also has a handle 42 and part of a latch mechanism 44 for interconnecting the two doors to each other.

According to one aspect of the present invention, the top section 22 is vertically adjustable relative to the bottom section 20 through the structure which is illustrated in FIG. 9. Thus, the lower and upper sections are interconnected to each other through extensions or reinforcement alignment channels 50 that are configured similar to channels 24, 26 and 34, 36 and fit snugly therein. These channel extensions are preferably permanently secured by welding into the upper channels 34 and 36 and extend downwardly into the lower channels 24 and 26. Also, the sheet 30 is cut back a distance equal to the maximum height adjustment for the door along the post means 24 and 26. According to one aspect of the invention, the front and rear post means or channels 24 and 26 have scribe lines A, B, and C (FIG. 10) defined thereon which define different adjusted positions for different height adjustments for the overall height of the door, which will be explained further in connection with the chart illustrated in FIG. 12.

Figure 4:
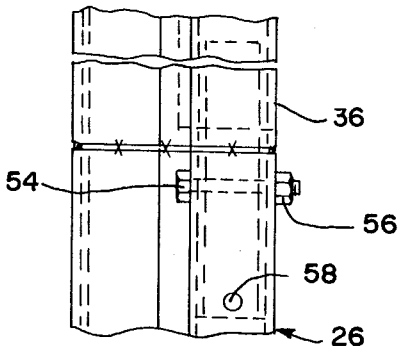
FIG. 4 is an enlarged fragmentary plan view of the joint between the two door sections.
Figure 2:
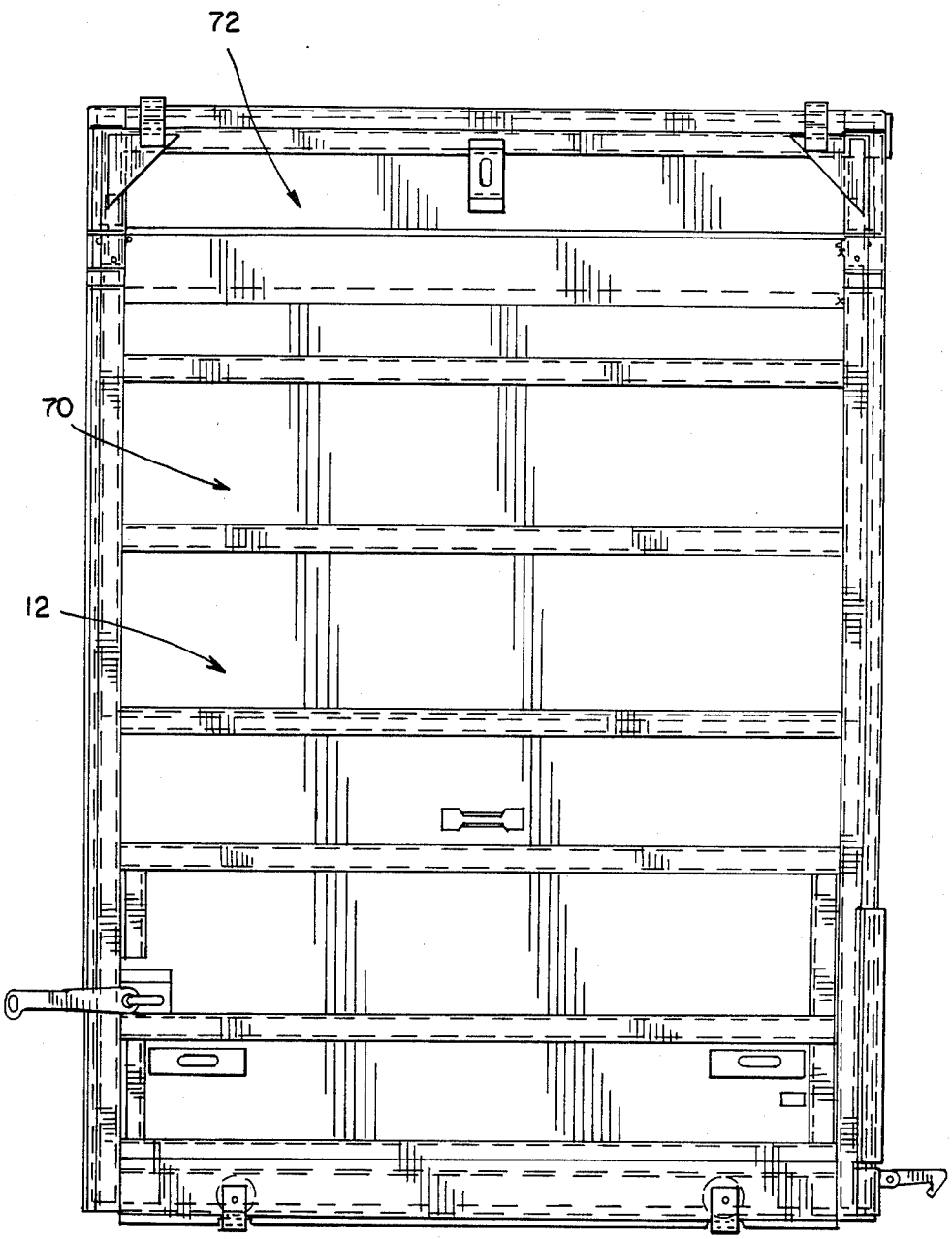
FIG. 2 is a plan view of an adjustable railway boxcar main door constructed in accordance with present invention.
Figure 3:
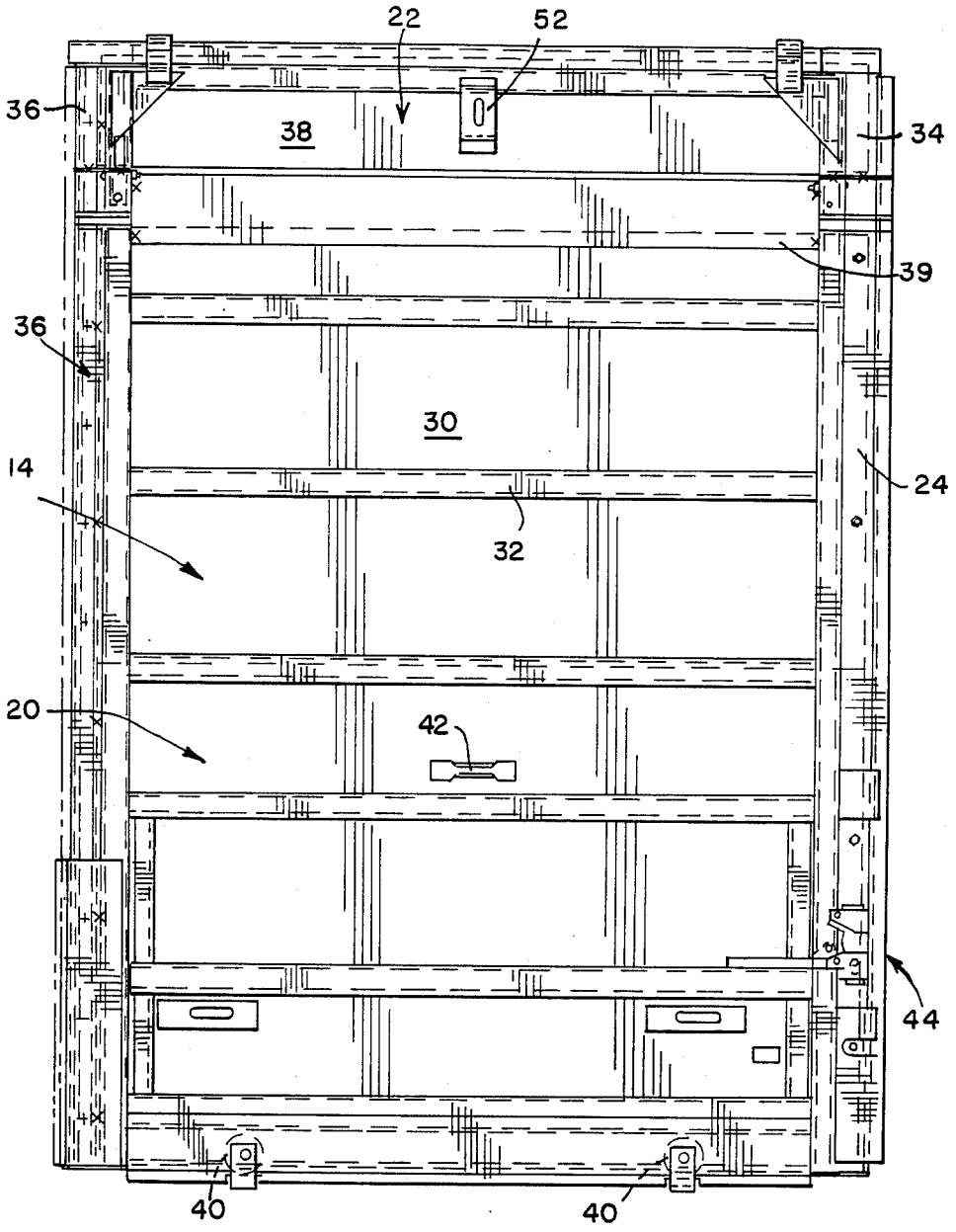
FIG. 3 is a plan view similar to FIG. 2 showing the auxiliary door constructed in accordance with the present invention.

In the preassembly of the door, the door is adjusted to the maximum height incorporated into the design of the door and the channel extensions 50 are tack-welded to the front and rear post means. The overlapping portion of the sheets 30 and 38 are also tack-welded at spaced locations throughout the entire length of the overlapped edge. Since the door is lifted and moved about during transportation and initial location by being suspended by a hook 52 located in the upper section, additional rigidity may be required prior to final assembly in an adjusted position. For this purpose, the front and rear panels or post means 24 and 26 have aligned openings in the legs of the channels which are aligned with openings in the extensions and bolts 54 and nuts 56 (FIG. 4) are utilized to provide stability between the sections prior to final assembly in an adjusted position. A huck bolt and collar may be received into opening 58 to provide additional stability for the door.

Before describing the adjustment features, the width adjustment will also be briefly described. The width adjustment is accomplished through a rear edge extension 60 (FIG. 5) which is substantially J-shaped in cross-section and has a free leg 62 which is adapted to provide a seal with an adjacent edge of the car when the door is in the fully closed position. The J-shaped extension is secured in overlapping relation to the rear integral flange 28 by welding and again may be adjusted to different positions. For this purpose, the rear flange 28 has scribe lines A1, B1 and C1 (FIG. 11) defined thereon. These scribe lines also are defined in the upper rear edge flange associated with the rear post means 36.

In the pre-assembly of the door at the factory, the extension 60 is tack-welded to the flange 28 at a location which defines the minimum width for the door. A rear edge bumper 64 is also provided by the manufacturer, but is not assembled at the factory and is strapped to the door at a desired location.

When it is desired to perform the final assembly for the door to an adjusted height and width, the door is placed on a flat even working surface and the chart of FIG. 12 provided with the door is evaluated to see whether a height or width adjustment is necessary. For example, a Class 1 car has an opening defined by the dimension illustrated in the chart. This dimension has the door width at the minimum width which is the position already assumed by the extension 60 so that it is only necessary to fill in the weld on the rear edge extension along the overlapping edges with the flange 28. For this purpose, additional holes 68 may be provided at spaced locations on the flange for providing additional welding.

After the rear edge extension has been permanently welded to the flange 28, the bumper 64 is moved into position, illustrated in FIG. 5, and is secured to the rear post means 26 and the extension 60 by welds 69.

If a width adjustment is necessary, the tack-welds, which hold the rear edge extension in place, are severed and the rear edge extension is removed and set aside. The chart is then resorted to determine the adjustment that must be made and the edge of the rear edge extension is aligned with any one of the adjustment scribe lines Al, Bl or Cl, as defined by the chart in FIG. 12. The rear edge extension is then aligned with the appropriate scribe line and the extension is permanently welded only to the flange of the lower section and is free of the rear flange of the upper section.

The next step is to make the necessary height adjustment of the door if such is required. Again, the chart is consulted for the Class of car receiving the door and the proper height adjustment is made. If a height adjustment is not required (such as a Class 2 car), the weld is filled in on the door sheet at the overlapping edges along the entire length and the butting edges between the front and rear post means and the extensions 50. In this instance, after the welds have been made, the bolts and nuts 56 and 54 are removed and the door is ready for installation.

If a height adjustment is required, the tack-welds are broken along the front and rear post means, as well as along the sheet, and the huck bolts and collars in the opening 58 are removed so that the upper section is free of the lower section of the door. The reinforcement aligning channels are then separated from the lower post means 24 and 26 and the chart is resorted to for the necessary adjustment to be made. After the necessary scribe line A, B or C has been selected, the excess portion of the front and rear post means is burned off along the appropriate scribe line so that the dimension needed to achieve the required door height is obtained.

The top section is then again assembled to the bottom section by telescoping the extensions or reinforcement alignment channels 50 into the front and rear post means 24 and 26 of the upper section abut the upper edges of the lower sections and of the lower section and the front and rear post means are welded to the extensions and the opening 58 that previously held the bolt and collar is filled in with weld and the exposed edges of the overlapping portions of the sheet are also continuously welded along the length thereof so that the upper section is secured to the lower section. It should be noted that the overlap 39 is sufficient to accommodate the entire range of adjustment for the door.

From the foregoing, it will be appreciated that the railway car door kit assembled according to this invention can be utilized for accommodating a variety of different door opening sizes on a railroad car utilizing one package that considerably minimizes the inventory required by the door manufacturer.

In the specific embodiment illustrated, the width adjustment is made on the auxiliary door only, while the height adjustment is made in a similar fashion on both doors 12 and 14 by adjustment of the upper section 72 of the main door with respect to the lower section 70 in the same manner described above.

Figure 6:
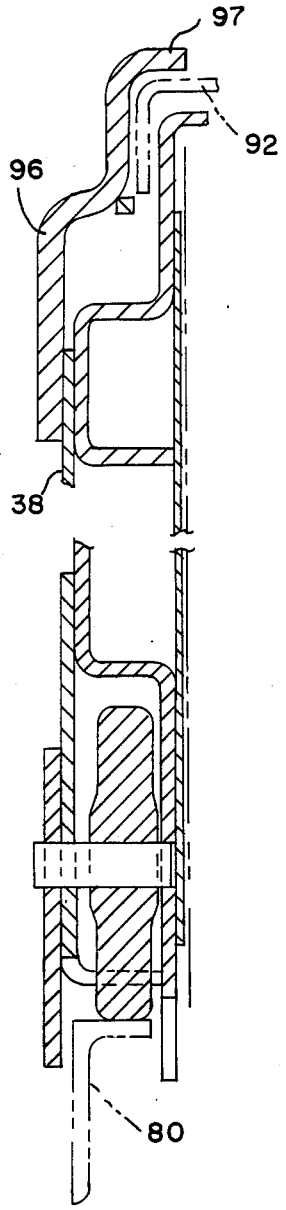
FIGS. 6, 7 and 8 are fragmentary cross-sectional views of the lower and upper edges of the doors.
Figure 7:
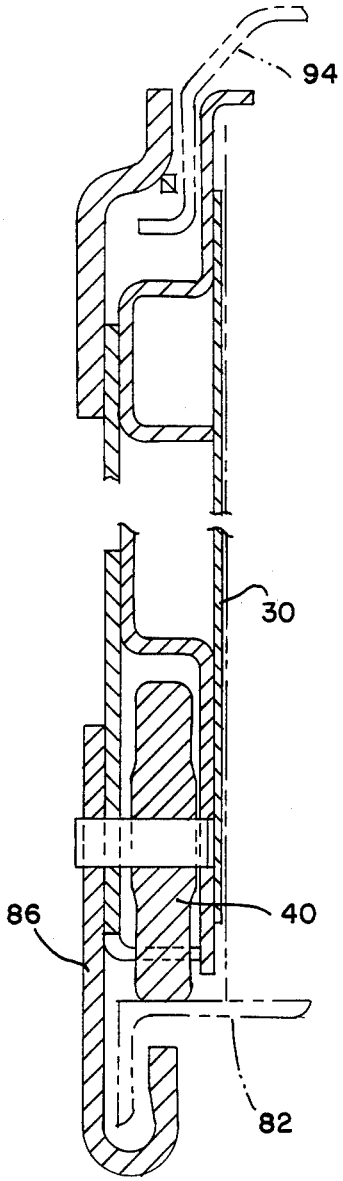
Figure 8:
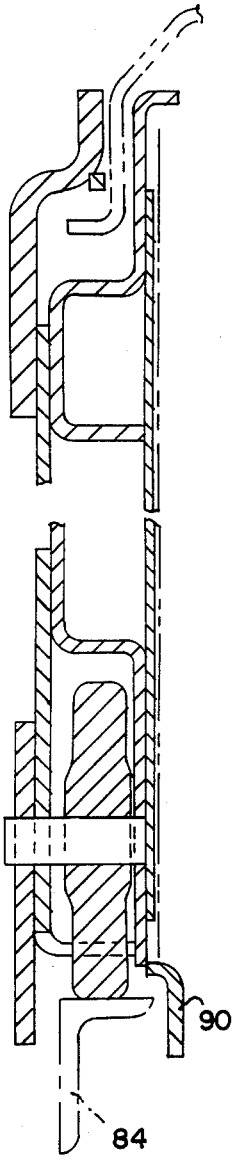

According to a further aspect of the invention, different railcar Classes also have different rails associated therewith for supporting the doors, as well as different configurations of upper guides for guiding the upper edge of the door along the side of the car. Thus, as illustrated in FIGS. 6, 7, and 8, three different types of rails 80, 82 and 84 are illustrated, which are common types of rails that are found on a variety of different railway cars. In order to provide for proper guiding of the door on the rails, a J-shaped extension 86 is provided and defines the lower edge of the door and guides the door along the tracks, such as track 82 (FIG. 7). With the type shown in FIG. 7, the flange or J-shaped extension receives the vertical leg of the rail and prevents the door from slipping off of the rail. A portion of the lower edge of the door must also be removed to accommodate the horizontal leg of the rail.

If a rail of the configuration illustrated in FIG. 6 is associate with the car, an appropriate portion of the J-shaped leg is burned off, as illustrated in FIG. 6, to accommodate the inverted L-shaped rail 80. If a rail or track of the type illustrated in FIG. 8 is used, the lower portion of the J-shaped extension is removed, as well as a lower edge portion of the door, and a separate guide element 90 is secured to the lower edge of the door to again guide the door along the track 84.

As indicated above, the upper edge of the door must also be capable of accommodating different horizontal upper guide rails that are associated with various Classes of railroad cars. For example, FIG. 6 illustrates a generally L-shaped guide element associated with the upper edge of the door, while FIG. 7 illustrates a differently configured guide rail 94. To accommodate these differences, the upper edge of the door is defined by an upper edge extension 96 that is secured to the door by welding and has a horizontal portion 97 extending inwardly in overlapping relation to the upper edge of the door. With the type of guide rail illustrated in FIG. 6, the upper edge extension is properly configured to receive the guide 92 without any modification. However, if the upper guide rail is of the type illustrated at 94 in FIG. 7, it is necessary to burn off the upper L-shaped leg down to be flush with the upper edge of the upper door.

As can be appreciated from the above description, the present invention provides a unique door kit that is capable of accommodating railroad cars of a variety of different Classes having different door openings, sizes, as well as different configurations for the hardware associated with the door for supporting the door on the car. Of course, various modifications come to mind without departing from the spirit of the invention. For example, the width adjustment could be varied substantially more and many more adjustments could be made, as well as the number and amount of height adjustment that are incorporated into a universal door of this type. The door assembly described above is specifically designed to accommodate eight different Classes of doors presently being marketed by a competitor, requiring an inventory of eight different doors having size and height variations.

We claim:

1. An adjustable railway boxcar door comprising a bottom section and an upper section with said bottom section having support means adjacent a lower edge for support on a rail, and an upper edge, post means defining front and rear edges for said bottom section with sheet means extending between said post means, said upper section having additional post means along front and rear edges aligned with said post means on said bottom section, said upper section having extensions extending from lower ends of said post means and received into said post means of said bottom section, said post means being channel-shaped in cross-section and said extensions having a corresponding channel shape with said extensions being welded to said post means to stabilize said door during handling prior to final assembly in adjusted position, said upper section having a sheet extending between said post means and having a lower portion overlapping said sheet means on said bottom section, said post means of said lower section having scribe lines to define different adjusted positions and said overlapping being sufficient to accomodate the entire range of adjustment defined by said scribe lines, and fastener means maintaining said sections in adjusted positions.

2. An adjustable railway boxcar door as defined in claim 1, in which said rear edge post means includes a rear edge extension movable with respect to said rear edge post means with said post means having scribe lines defining different width adjustments for said door and in which said rear edge extension is welded to said post means after being moved to an adjusted position.

3. An adjustable railway boxcar door as defined in claim 2, further including a lower bumper covering a lower portion of said rear edge extension and post means and being welded thereto.

4. A railway boxcar door kit comprising a lower section having front and rear channels and an upper section having corresponding front and rear channels with said rear channels having integral rearwardly-directed flanges, each section having a sheet extending between said channels with said sheets having an overlapping portion, a generally J-shaped rear edge extension adjacent to be welded to said flanges with said flanges having scribe lines defining different width adjustments for said door, and reinforcement alignment channels adapted to snugly fit into said channels of said lower and upper sections, said front and rear channels of said lower section having scribe lines defining different height adjustments for said door, said overlapping portion being sufficient to accomodate the entire range of adjustment defined by said scribe lines, said alignment channels being permanently welded in said channels of said top section, and further including stabilizing securing means extending through said channels of said lower section and said alignment channels and providing stability between said sections for handling prior to being permanently welded in an adjusted position.

5. A railway boxcar door kit as defined in claim 4, including a lower portion rear edge bumper is adapted to be secured to the lower rear edge extension and lower rear channel by welding.

6. A railway boxcar door kit as defined in claim 4, in which said lower section has an elongated pocket extending from a lower edge with spaced rollers supported in said pocket and extending outwardly to ride on rails formed on the boxcar, and further including a hook-shaped rail guard extending along said lower edge, said rail guard and said lower edge having selected portions removable to accommodate rails of different configurations.

7. A railway boxcar door kit as defined in claim 4, in which a substantial majority of said door is defined by said lower section.

8. A method of adjusting a railway boxcar door for height and width including separate bottom and top sections having front and rear hollow post means defining front and rear edges with said rear post means having an integral rearwardly-directed flange having spaced parallel scribe lines thereon and an extension temporarily secured thereto, upper ends of said front and rear post means having exposed scribe lines defined thereon defining different height adjustments, said front and rear post means having sheets extending therebetween with the sheet on one section overlapping the sheet on the other section, and said front and rear post means of said upper section having alignment channels secured thereto with a portion received into said hollow post means of said lower section and temporarily secured thereto, comprising the steps of selecting the height of door required for a particular car Class from a chart provided with the door with the chart having indicia associated with respective height scribe lines, separating said top section from said bottom section and removing said top section, removing a desired portion of the upper end of said front and rear post means along a selected scribe line, and securing said alignment channels in said post means of said lower section by welding and also welding the overlapping edges of said sheets to produce a selected door height,-selecting a door width scribe line from said chart and aligning an edge of said extension with a selected width scribe line and permanently securing said extension to said flange by welding.

9. The method of claim 8, in which the temporary securement of said sections includes bolts extending through said alignment means of said lower section, including the further step of removing said bolts prior to final assembly of said door.

* * * * *